US009861259B2

(12) United States Patent
Jung et al.

(10) Patent No.: US 9,861,259 B2
(45) Date of Patent: Jan. 9, 2018

(54) DISHWASHER

(71) Applicant: SAMSUNG ELECTRONICS CO., LTD., Suwon-si, Gyeonggi-do (KR)

(72) Inventors: Jun Kyu Jung, Seongnam-si (KR); Jeon Suk Wee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 747 days.

(21) Appl. No.: 14/294,652

(22) Filed: Jun. 3, 2014

(65) Prior Publication Data

US 2015/0068056 A1 Mar. 12, 2015

(30) Foreign Application Priority Data

Sep. 12, 2013 (KR) ..... 10-2013-0109926

(51) Int. Cl.
*F26B 19/00* (2006.01)
*A47L 15/48* (2006.01)
*A47L 15/42* (2006.01)

(52) U.S. Cl.
CPC ..... *A47L 15/488* (2013.01); *A47L 15/4217* (2013.01); *A47L 15/483* (2013.01); *A47L 2401/10* (2013.01); *A47L 2501/30* (2013.01)

(58) Field of Classification Search
CPC .. A47L 15/488; A47L 15/483; A47L 15/4246; A47L 15/0013; A47L 15/0034
USPC ..... 34/218, 219; 134/105–108
See application file for complete search history.

(56) References Cited

U.S. PATENT DOCUMENTS 4,359,187 A * 11/1982 Moore ..... F28D 21/0008 126/99 R
9,351,628 B2 * 5/2016 Erozkan ..... A47L 15/486
2005/0223583 A1 * 10/2005 Lee ..... D06F 58/24 34/73
2007/0131261 A1 * 6/2007 Lee ..... A47L 15/4217 134/112
2010/0300499 A1 * 12/2010 Han ..... A47L 15/483 134/172
2013/0032180 A1 * 2/2013 Ak ..... A47L 15/488 134/184

FOREIGN PATENT DOCUMENTS

KR 10-2007-0065969 6/2007
KR 10-0772230 10/2007
KR 10-2008-0083393 9/2008

* cited by examiner

*Primary Examiner* — John McCormack
(74) *Attorney, Agent, or Firm* — Staas & Halsey LLP

(57) ABSTRACT

Disclosed herein is a dishwasher. The dishwasher includes a main body, a tub placed within the main body to receive dishes therein, and an air brake mounted to one lateral surface of the tub. The air brake includes a communication hole communicating with the tub to allow air to be introduced into the tub or to be discharged from the tub, a guide rib configured to guide air, introduced through the communication hole, upward of the air brake, and a vent formed in a lateral surface of the air brake to allow air to be discharged outward from the air brake or to allow outside air to be introduced into the air brake, the vent being located below the guide rib to prevent hot air from being discharged from the air brake.

19 Claims, 10 Drawing Sheets

DISHWASHER

CROSS-REFERENCE TO RELATED APPLICATIONS

This application claims the benefit of Korean Patent Application No. 10-2013-0109926, filed on Sep. 12, 2013 in the Korean Intellectual Property Office, the disclosure of which is incorporated herein by reference.

BACKGROUND

1. Field

Embodiments of the present disclosure relate to a dishwasher in which an air brake having an improved configuration is mounted to a tub.

2. Description of the Related Art

A dishwasher is an apparatus that automatically removes food residue adhered to bowls, spoons, and various other cooking utensils (hereinafter referred to as 'dishes') using detergent and wash water.

A dishwasher includes a tub in which dishes are received, a sump mounted to the bottom of the tub, wash water being stored in the sump, a withdrawable dish basket disposed in the tub, and a nozzle assembly to inject wash water. After dishes are stored in the dish basket, wash water is moved to the nozzle assembly via pumping of a wash water pump mounted in the sump. Thereby, the dishes are washed by the wash water injected from the nozzle assembly.

During washing and rinsing cycles of dishes, hot wash water is used, and thus hot and humid air is generated. The resulting air is discharged through an air brake mounted to the tub. In addition, during a drying cycle, dry outside air is introduced through the air brake to enhance drying performance.

In recent years, built-in dishwashers have been increasingly used. Since built-in dishwashers are usually surrounded by wood furniture, the hot and humid air discharged from the air brake may cause damage to the furniture. Moreover, the built-in dishwashers may exhibit poor drying efficiency due to difficulty in the introduction of dry outside air.

SUMMARY

Therefore, it is an aspect to provide a dishwasher in which an air brake has an improved configuration to prevent hot and humid air from being discharged outward during washing and rinsing cycles.

Additional aspects will be set forth in part in the description which follows and, in part, will be obvious from the description, or may be learned by practice of the invention.

In accordance with one aspect, a dishwasher includes a main body, a tub placed within the main body to receive dishes therein, and an air brake mounted to one lateral surface of the tub, wherein the air brake includes a communication hole communicating with the tub to allow air to be introduced into the tub or to be discharged from the tub, a guide rib configured to guide air, introduced through the communication hole, upward of the air brake, and a vent formed in a lateral surface of the air brake to allow air to be discharged outward from the air brake or to allow outside air to be introduced into the air brake, the vent being located below the guide rib to prevent hot air from being discharged from the air brake.

The dishwasher may further include a condenser formed on at least a portion of the air brake to condense hot air directed from the tub into the air brake.

The air brake may be constructed by coupling a first housing and a second housing to each other, the first housing being coupled to the tub.

The condenser may include a first condenser formed at the first housing and a second condenser formed at the second housing. The communication hole and the guide rib may be formed at the first housing. The air brake may further include a third condenser extending from the guide rib. At least a portion of the guide may be bent. The guide rib may include a partition extending from the vent. The second condenser may protrude from a surface of the second housing inward of the air brake. The second condenser may protrude from a surface of the second housing outward of the air brake.

The dishwasher may further include a wash water flow path including a first flow path for movement of wash water from a lower end to an upper end of the air brake and a second flow path for movement of wash water from the upper end to the lower end of the air brake.

The air brake may further include a sensor unit to sense the amount of wash water introduced into the air brake, and the wash water may be introduced into the tub through the communication hole after passing the sensor unit.

In accordance with an aspect, a dishwasher includes a main body, a tub placed within the main body to receive dishes therein, and an air brake mounted to one lateral surface of the tub, wherein the air brake includes a communication hole communicating with the tub to allow air or wash water to be introduced into the tub, a vent formed at a side of the communication hole to allow air to be discharged outward from the air brake or to allow outside air to be introduced into the air brake, and at least one condenser configured to condense humid air introduced into the air brake.

The air brake may be constructed by coupling a first housing and a second housing to each other, the first housing being coupled to the tub.

The first housing may be provided with a guide rib defining a partition of the vent to guide air, introduced through the communication hole, toward the vent.

The condenser may include a first condenser formed at the first housing, a second condenser formed at the second housing, and a third condenser extending from the guide rib. The first condenser and the second condenser may be separated from the vent. The second condenser may protrude from a surface of the second housing inward of the air brake. The second condenser may protrude from a surface of the second housing outward of the air brake.

In accordance with an aspect, a dishwasher includes a main body, a tub placed within the main body to receive dishes therein, and an air brake mounted to one lateral surface of the tub, wherein the air brake includes a communication hole communicating with the tub to allow air to be introduced into the tub or to be discharged from the tub, a vent defining a passage in a lateral surface of the air brake to allow air to be discharged outward from the air brake or to allow outside air to be introduced into the air brake, and a wash water flow path to guide wash water into the tub, the wash water flow path including a first flow path for movement of wash water from a lower end to an upper end of the air brake and a second flow path for movement of wash water from the upper end to the lower end of the air brake.

The air brake may further include a sensor unit to sense the amount of wash water introduced into the air brake.

The wash water flow path may further include a third flow path connecting the sensor unit and the communication hole to each other.

The air brake may further include a guide rib defining a partition between at least a portion of the communication hole and the vent, so as to guide air, introduced through the communication hole, upward of the air brake.

The air brake may further include a condenser formed on at least a portion thereof to condense hot air directed from the tub into the air brake.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
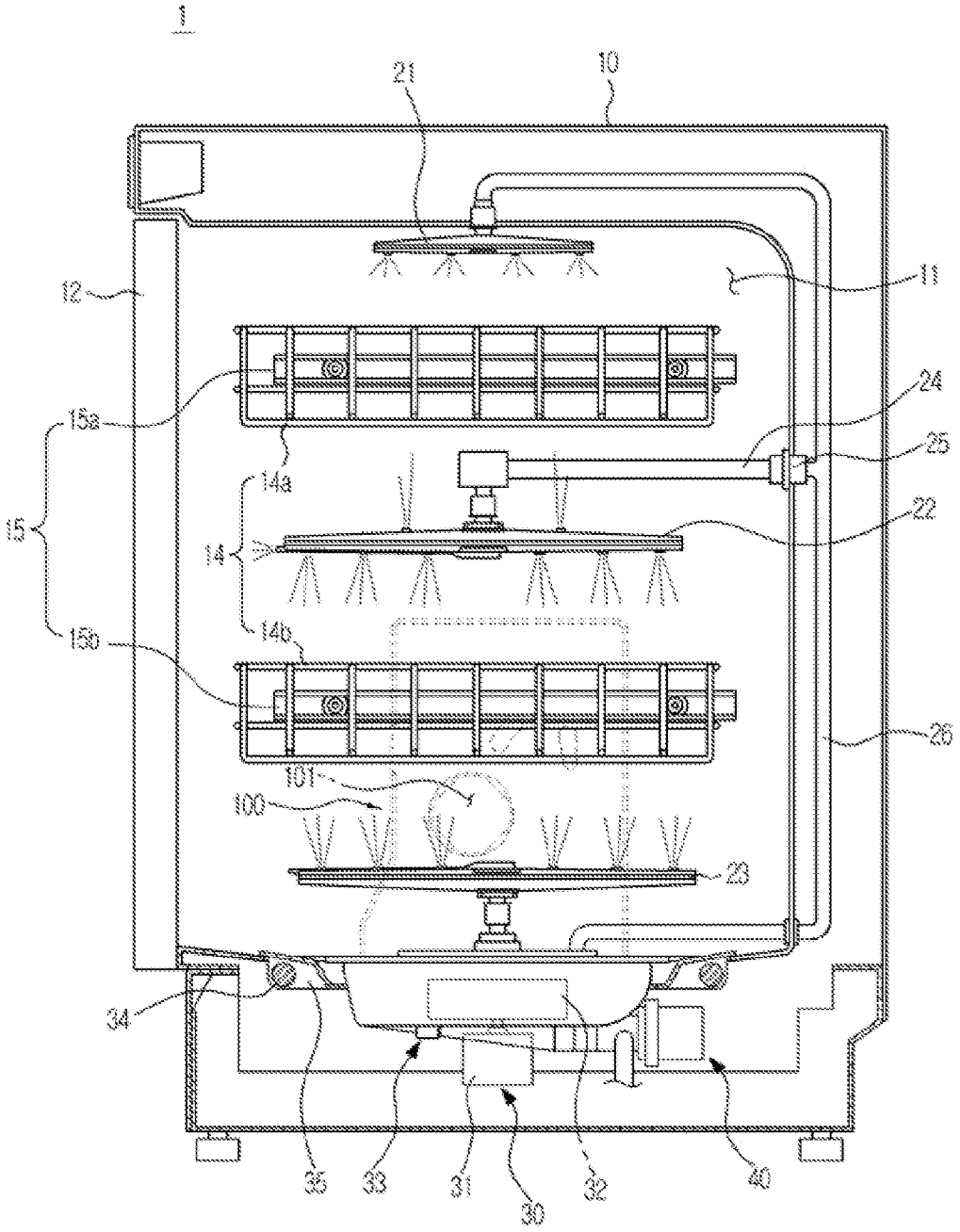
FIG. 1 is a sectional view showing a dishwasher according to one embodiment.

Reference will now be made in detail to embodiments, examples of which are illustrated in the accompanying drawings, wherein like reference numerals refer to like elements throughout.

Figure 2:
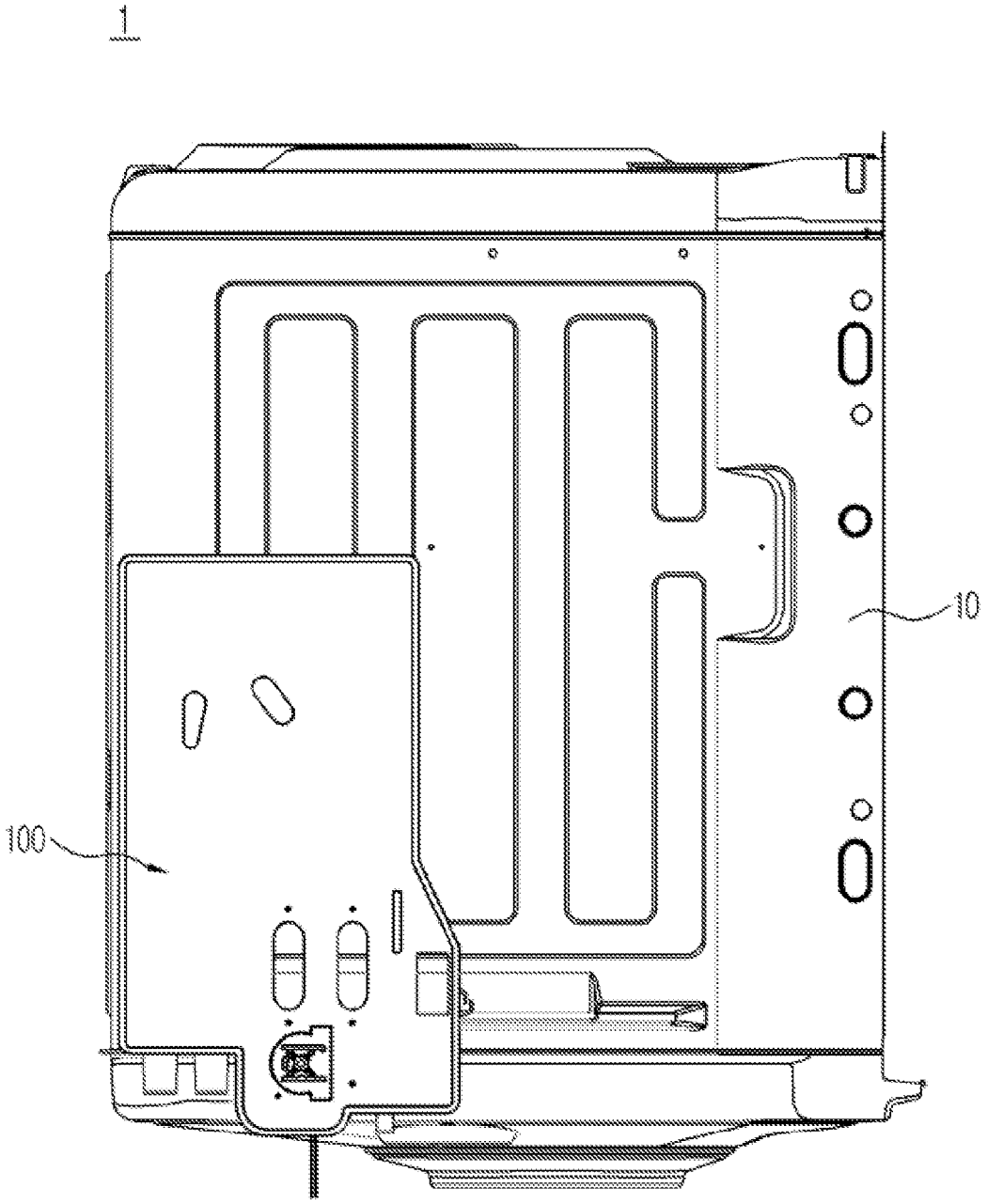
FIG. 2 is a view showing one surface of a main body of the dishwasher according to one embodiment.
Figure 3:
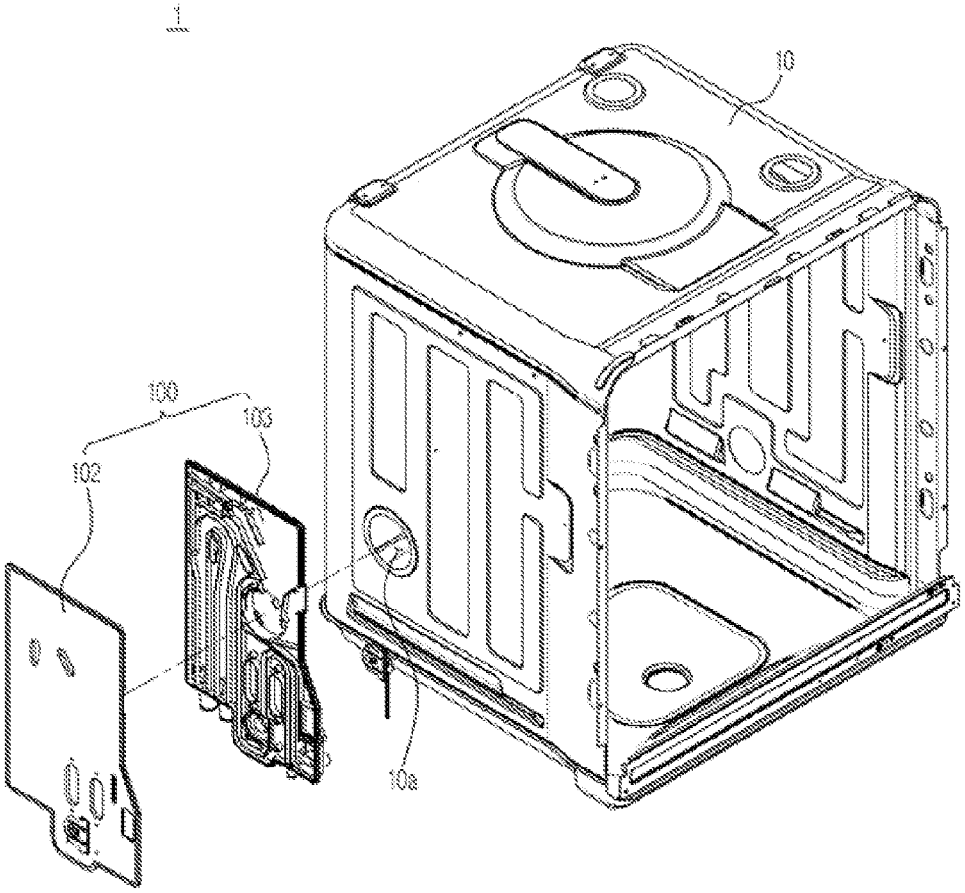
FIG. 3 is an exploded perspective view showing an air brake disassembled from the dishwasher according to one embodiment.

FIG. 1 is a sectional view showing a dishwasher according to one embodiment, FIG. 2 is a view showing one surface of a main body of the dishwasher according to one embodiment, and FIG. 3 is an exploded perspective view showing an air brake disassembled from the dishwasher according to one embodiment.

As exemplarily shown in FIGS. 1 to 3, the dishwasher 1 includes a main body 10 defining an external appearance of the dishwasher 1, a tub 11 placed within the main body 10, and a sump 30 placed below the tub 11, wash water being stored in the sump 30. The interior of the tub 11 defines a dish washing space in which dishes are received.

The front of the main body 10 may be open such that dishes are introduced into the tub 11 or removed from the tub 11. A door 12 is installed to the front of the main body 10 such that a lower end of the door 12 is hinged to a front lower end of the main body 10 to open or close the tub 11 via pivotal rotation thereof. A detergent box (not shown) may be mounted to one surface of the door 12 to supply detergent into the tub 11.

A pair of dish baskets 14 is installed in upper and lower regions of the tub 11 so as to be movable inward and outward. The top of each of the baskets 14 is open to provide a dish receiving portion. The dish baskets 14 are inserted into or withdrawn from the main body 10 through the open front of the main body 10 by at least one rack 15 that supports the dish baskets 14 in a sliding manner.

The dish baskets 14 are formed of wires arranged in the shape of a lattice such that dishes received in the dish baskets 14 may be washed while being exposed outward from the dish baskets 14.

One or more nozzle assemblies 21, 22, 23 are mounted in the tub 11 to inject wash water above, below and between the two dish baskets 14 to enable washing of dishes received in the dish baskets 14. These nozzle assemblies may include a first nozzle assembly 21 located above an upper dish basket 14*a* and a second nozzle assembly 22 located above a lower dish basket 14*b*. In addition, a third nozzle assembly 23 may be located below the lower dish basket 14*b*. Each of the first nozzle assembly 21, the second nozzle assembly 22, and the third nozzle assembly 23 is rotatable about a rotating axis thereof to inject water while being rotated.

The tub 11 may include a heater 34 to heat wash water and a heater mounting recess 35. The heater mounting recess 35 is formed in the bottom of the tub 11 and the heater 34 is mounted in the heater mounting recess 35.

The sump 30 is installed at the bottom center of the tub 11 to collect and pump wash water. The sump 30 includes a wash water pump 32 to pump wash water at a high pressure and a pump motor 31 to drive the wash water pump 32.

The wash water pump 32 pumps wash water to the uppermost first nozzle assembly 21 through a first supply pipe 26, and pumps wash water to the second nozzle assembly 22 through a second supply pipe 24 diverged from the first supply pipe 26.

An air brake 100 may be connected to one lateral surface of the tub 11. The air brake 100 is coupled to an outer surface of the main body 10, so as to communicate with the tub 11 through a tub hole 10*a* perforated in the main body 10. Hot and humid air inside the tub 11 may be introduced into the air brake 100 to thereby be discharged outward, and dry outside air may be introduced into the air brake 100 to thereby be supplied into the tub 11. In addition, a portion of the air brake 100 may be connected to the sump 30 such that wash water is introduced into the tub 11 through the air brake 100. The air brake 100 will be described in detail below.

The sump 30 may include a turbidity sensor (not shown) that detects the contamination degree of wash water. A controller (not shown) of the dishwasher 1 may detect the contamination degree of wash water using the turbidity sensor (not shown), and control the number of times a washing operation or a rinsing operation is performed. That is, the controller (not shown) may increase the number of times a washing or rinsing operation is performed when the contamination degree is high, and may reduce the number of times a washing or rinsing operation is performed when the contamination degree is low.

Figure 4:
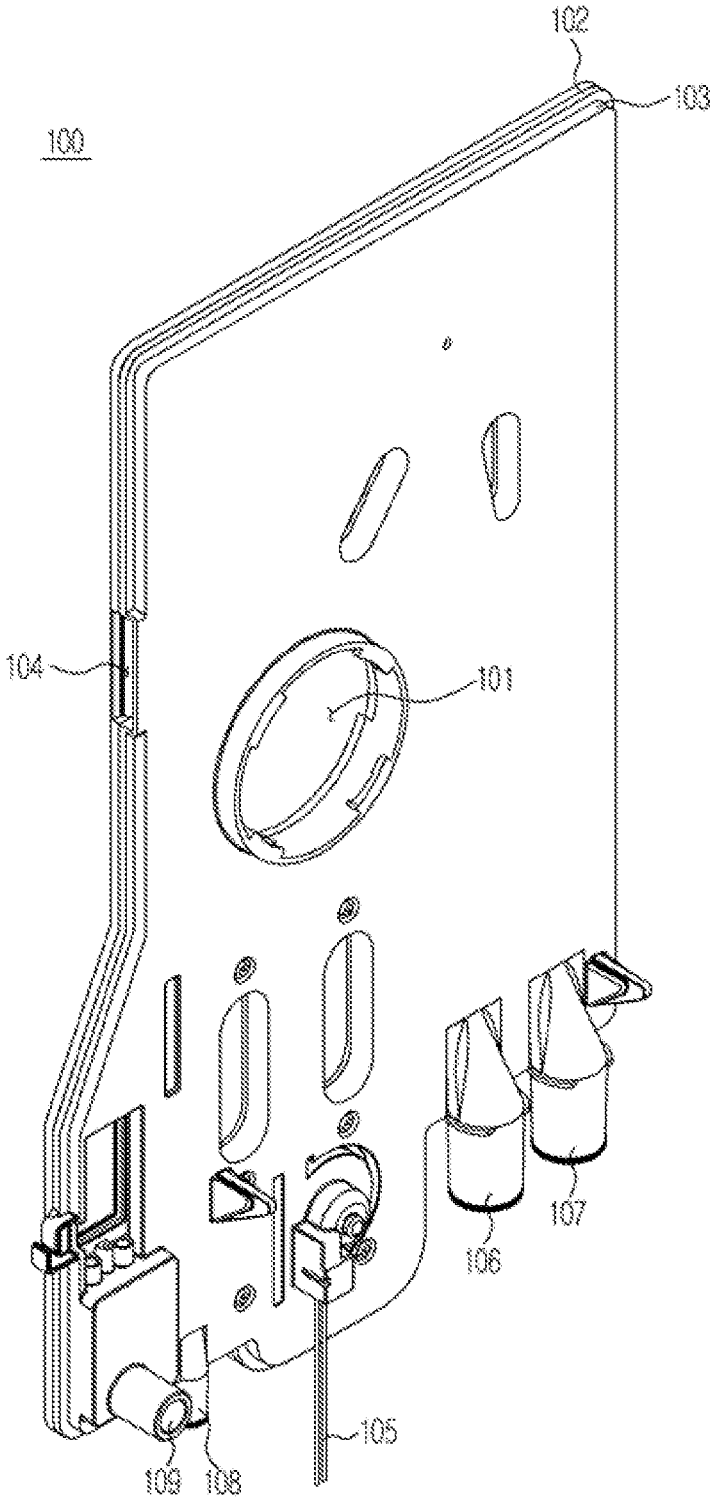
FIG. 4 is a view showing the air brake of the dishwasher according to one embodiment.
Figure 5:
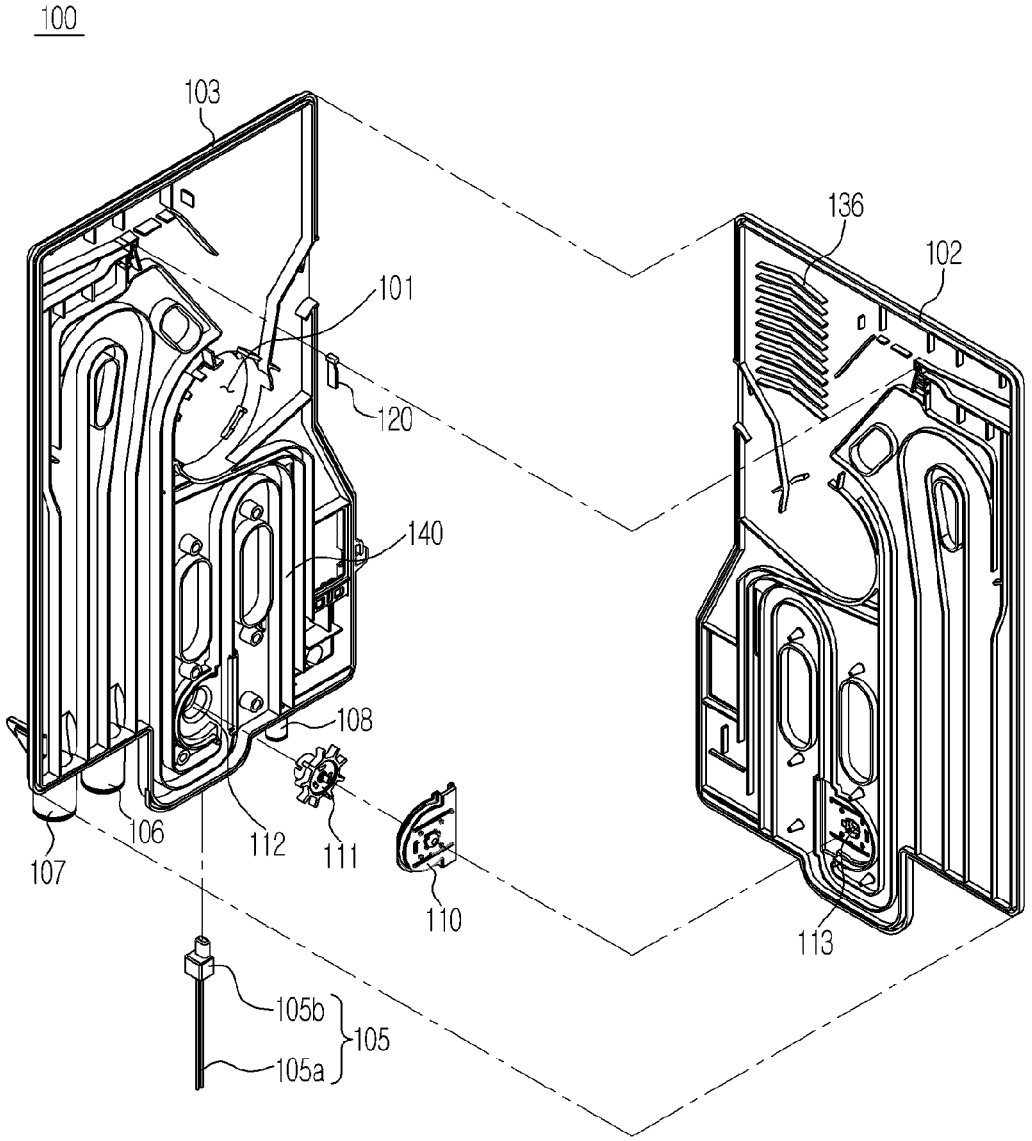
FIG. 5 is an exploded perspective view showing the air brake of the dishwasher according to one embodiment.

FIG. 4 is a view showing the air brake of the dishwasher according to one embodiment, and FIG. 5 is an exploded perspective view showing the air brake of the dishwasher according to one embodiment.

As exemplarily shown in FIGS. 4 and 5, the air brake 100 is constructed by coupling a first housing 103 and a second housing 102 to each other. The first housing 103 may be coupled to the tub 11.

The air brake 100 is provided at a lateral surface thereof with a vent 104 for outward discharge of air or introduction of outside air.

The air brake 100 may have a communication hole 101 that communicates with the tub 11 for introduction of air into the tub 11 or discharge of air from the tub 11. The communication hole 101 may be formed in the first housing 103 coupled to the tub 11.

The air brake 100 may further include a sensor unit 105; 110; 111 for sensing of the amount of wash water introduced. To sense the amount of wash water, the sensor unit 105; 110; 111 may be arranged in a wash water flow path 140. The sensor unit 105; 110; 111 may include an impeller 111 and a meter 105 that measures revolutions per minute of the impeller 111 and transmits a signal. In one embodiment, the impeller 111 may include a blade installed around a rotating shaft thereof.

An impeller cover 110 may be coupled to the impeller 111. The impeller 111 may be mounted in a seat 112 of the first housing 103 and the impeller cover 110 may be coupled to the impeller 111 so as to surround the impeller 111. Thereafter, the first housing 103 may be coupled to the second housing 102.

The meter 105 is mounted in the seat 112 to measure revolutions per minute of the impeller 111. When the impeller 111 is rotated by kinetic energy generated as wash water moving along the wash water flow path 140 comes into contact with the impeller 111, the meter 105 senses revolutions per minute of the impeller 111 and transmits a signal when the revolutions per minute exceeds a predetermined level. As a valve (not shown) closes the wash water flow path 140 in response to the signal, the amount of wash water to be supplied into the tub 11 is controllable.

The wash water flow path 140 may communicate with a water supply pipe 108 connected to the sump 30.

An overflow pipe 107 may be connected to a lower end of the air brake 100 to provide a path through which wash water and contaminants flow backward from the sump 30 when a filter of the sump 30 is clogged. To prevent the wash water and contaminants from flowing backward to the tub 11, a flow path connected to the overflow pipe 107 may have an inverted U-shaped form.

In addition, a valve 120 may be coupled to one side of the air brake 100 to close a flow path communicating with the tub 11, to prevent the wash water and contaminants from being introduced into the tub 11.

A soft water device connection pipe 106 may be provided at the air brake 100 such that water introduced into the air brake 100 is moved to a soft water device (not shown) through the soft water device connection pipe 106. Wash water collected in the soft water device connection pipe 106 is filtered while passing an ion exchange resin filter installed in the soft water device (not shown) to remove the contaminants contained in the wash water, which ensures easy washing.

Figure 6:
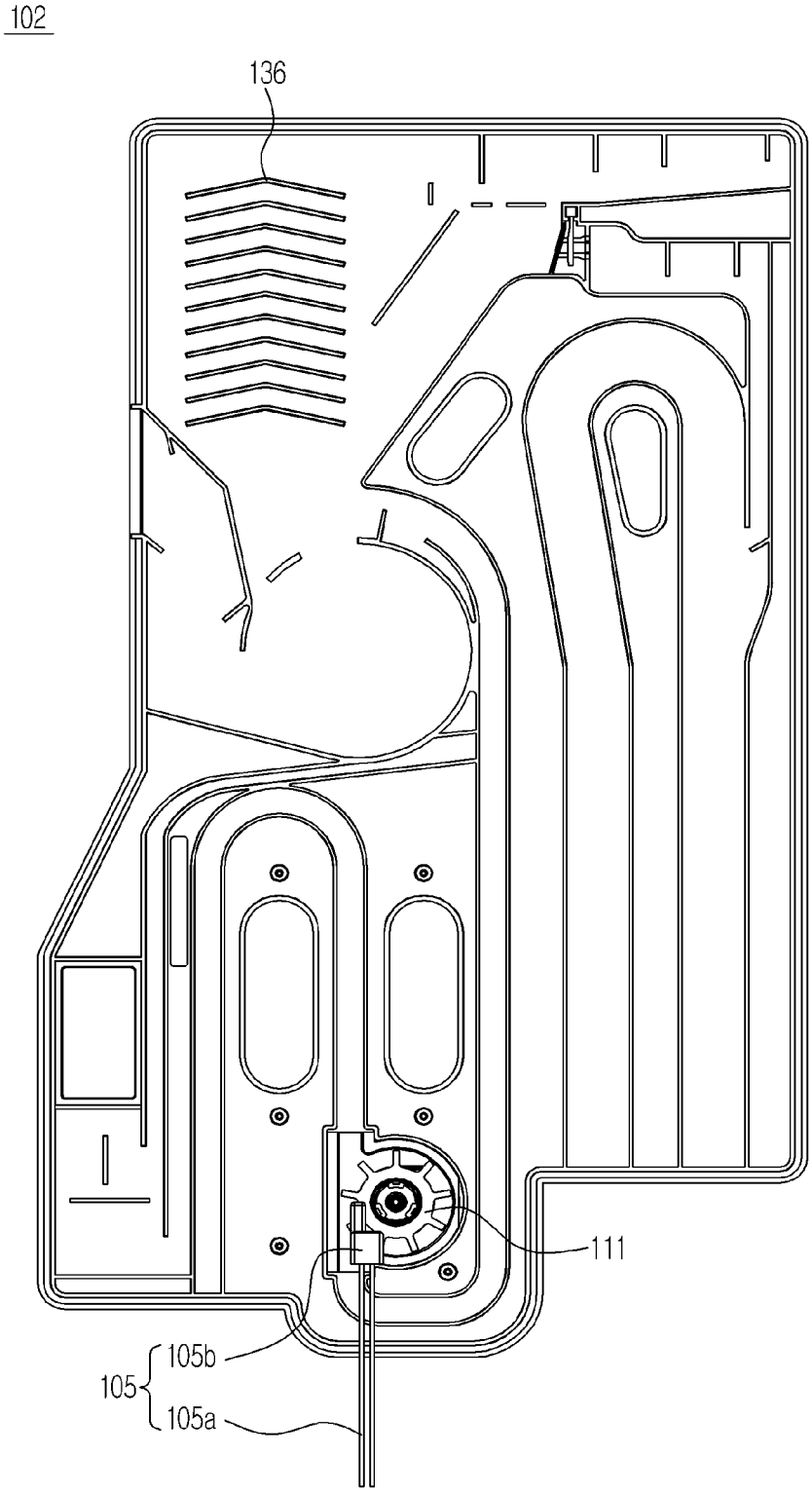
FIG. 6 is a view showing a second housing constituting the air brake of the dishwasher according to one embodiment.
Figure 7:
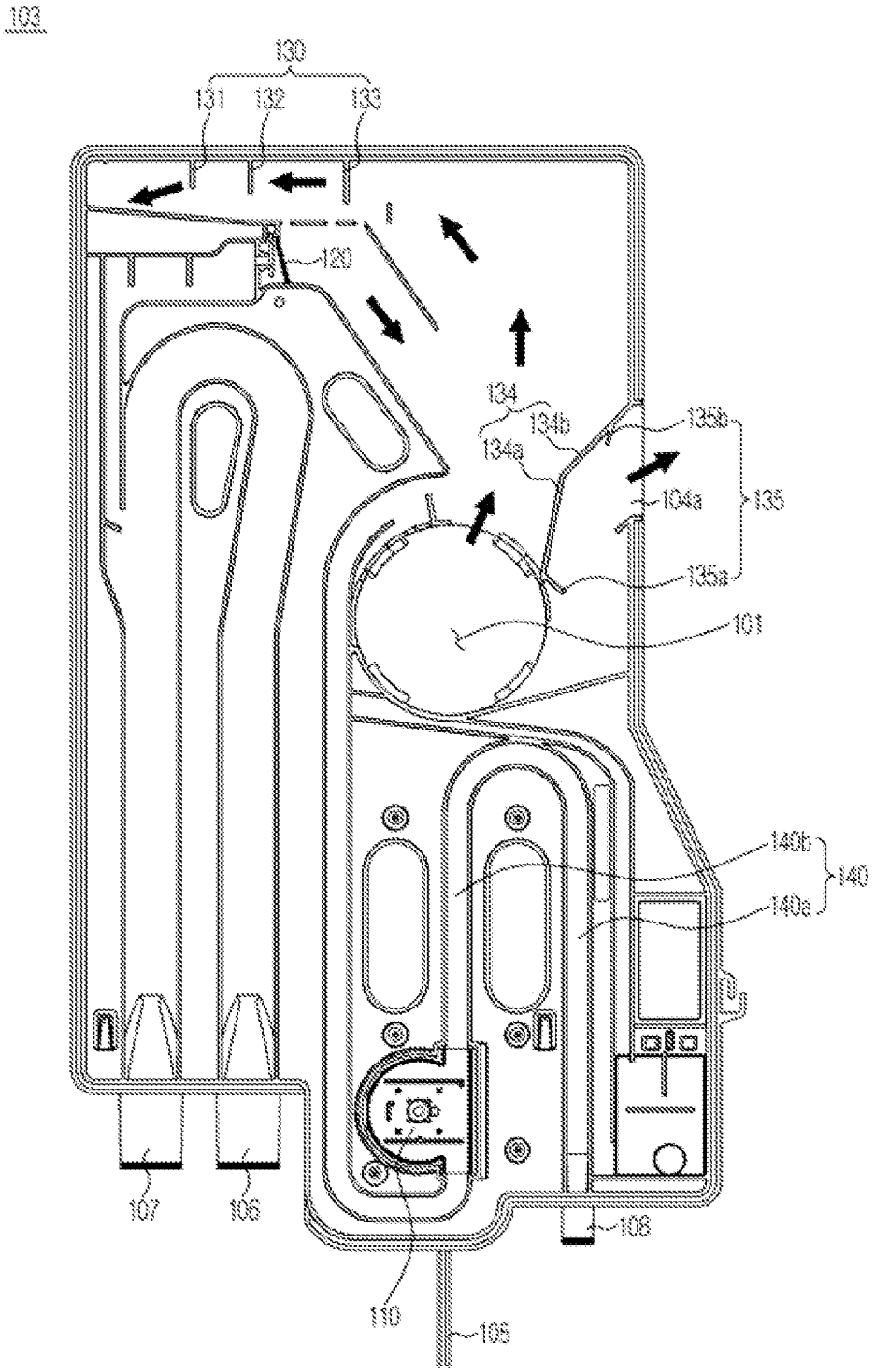
FIG. 7 is a view showing a first housing constituting the air brake of the dishwasher according to one embodiment.
Figure 8:
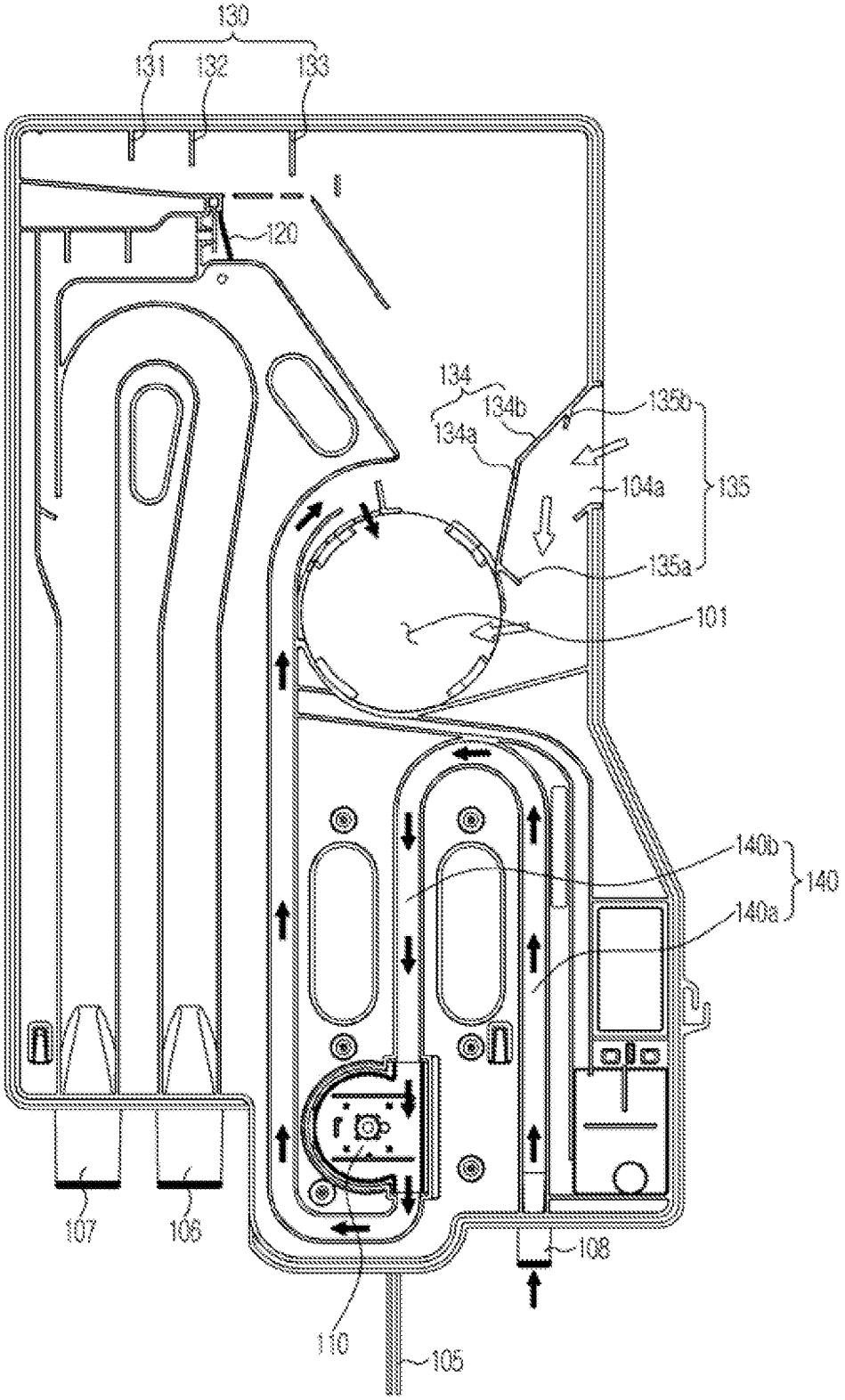
FIG. 8 is a view showing the first housing constituting the air brake of the dishwasher according to one embodiment.

FIG. 6 is a view showing the second housing constituting the air brake of the dishwasher according to one embodiment, FIG. 7 is a view showing the first housing constituting the air brake of the dishwasher according to one embodiment of, and FIG. 8 is a view showing the first housing constituting the air brake of the dishwasher according to one embodiment.

In FIG. 7, a movement path of hot and humid air directed from the tub 11 to the air brake 100 is represented by arrows. In FIG. 8, an introduction path of dry outside air into the air brake 100 is represented by white arrows, and a path of wash water introduced from the sump 30 into the air brake 100 and thence to the tub 11 is represented by black arrows.

As exemplarily shown in FIGS. 6 to 8, the vent 104 for introduction or discharge of air may be formed in a lateral surface of the first housing 103. A guide rib 134 may be provided at an upper end of the vent 104 to guide introduction of air. The guide rib 134 provided at the upper end of the vent 104 may guide hot and humid air directed from the tub 11 through the communication hole 101 such that the hot and humid air is discharged through the vent 104 after passing condensers 130, 135, 136. That is, the guide rib 134 prevents the hot and humid air having passed through the communication hole 101 from being directly discharged through the vent 104, thereby preventing damage to furniture around the dishwasher 1 due to the hot and humid air. The guide rib 134 may take the form of a partition extending from the vent 104. In this case, the guide rib 134 may also guide air introduced through the vent 104 to the top of the air brake 100.

At least a portion of the guide rib 134 may be bent. The guide rib 134 may be sloped downward of the air brake 100 and may include a first slope 134*a* and a second slope 134*b*. A boundary between the first slope 134*a* and the second slope 134*b* is bent.

To condense the hot and humid air directed from the tub 11 to the air brake 100, the condensers 130, 135, 136 may be arranged at specific positions of the air brake 100. The air coming into contact with the condensers 130, 135, 136 may be condensed due to a temperature difference.

According to one embodiment, the first housing 103 may be provided with a first condenser 130 and the second housing 102 may be provided with a second condenser 136. In addition, a third condenser 135 may extend from the guide rib 134. The condensers 130, 135, 136 may protrude in a given direction to increase contact area with air.

The second condenser 136 may protrude from a surface of the second housing 102 inward of the air brake 100. The second condenser 136 may be located above the communication hole 101 such that air introduced into the air brake 100 through the communication hole 101 comes into contact with the second condenser 136 while moving upward of the air brake 100. The second condenser 136 may have a centrally-pointed chevron, but is not limited thereto. When the second condenser 136 has a chevron form, the second condenser 136 has increased contact area with air, which may result in increased condensation effects. In addition, since the second condenser 136 in the form of a chevron has a pointed upper portion and is tapered downward, water drops generated via condensation of air may move downward along the second condenser 136 in the direction of gravity.

The first condenser 130 may protrude downward from a top surface of the air brake 100. The first condenser 130, for example, is comprised of three first condensers 131, 132, 133 having different lengths are provided, but the embodiment is not limited thereto. As such, the air, moved from the communication hole 101 to the top of the air brake 100 along the guide rib 134, may be condensed while coming into contact with the first condenser 130. That is, the hot and humid air introduced through the communication hole 101 may be primarily condensed by the second condenser 136, and then may be secondarily condensed by the first condenser 130. In addition, since the first condenser 130 protrudes downward from the top surface of the air brake 100, condensation of air may be accomplished with increased contact area between the first condenser 130 and the air, and water drops generated via condensation of air may move along the first condenser 130 in the direction of gravity.

Air condensed while passing the second condenser 136 and the first condenser 130 moves downward of the air brake 100 and is discharged from the air brake 100 through the vent 104. The vent 104 may be located at one side of the air brake 100 opposite to the other side of the air brake 100 where the first condenser 130 and the second condenser 136 are located. As such, the air, having passed the second condenser 136 and the first condenser 130, is accumulated in a condensing zone corresponding to a space above the vent 104. After the air fills the condensing zone, the air may be discharged outward through the vent 104 by way of the third condenser 135. That is, since the vent 104 is located at one side of the air brake 100 spaced apart from the first condenser 130 and the second condenser 136, it may be possible to prevent insufficiently condensed air from being discharged through the vent 104, which may increase condensation efficiency. The third condenser 135 protrudes from the guide rib 134 toward the vent 104. As such, air moving toward the vent 104 may be condensed while coming into contact with the third condenser 135. The third condenser 135 may include a third condenser 135*a* extending from the first slope 134*a* and a third condenser 135*b* extending from the second slope 134*b*. In addition, as the guide rib 134 is located between the vent 104 and the condensing zone, it may be possible to ensure that lower relative-humidity air, condensed and moved downward of the air brake 100, is discharged outward through the vent 104. The guide rib 134 serves not only to guide air directed from the tub 11 to move upward of the air brake 100, but also to guide sufficiently condensed air to be discharged outward through the vent 104.

Through the above described position of the vent 104 and the condensers 130, 135, 136 to prevent hot and humid air from being discharged outward prior to being condensed, it may be possible to prevent any damage due to discharge of the hot and humid air.

Conversely, when dry outside air is introduced through the vent 104, as represented by white arrows shown in FIG. 8, the guide rib 134 may guide the air to move to the communication hole 101 and thence to the tub 11, which may enhance drying efficiency of the air within the tub 11.

According to one embodiment, even if the volume of the air brake 100 and the size of the vent 104 are reduced, enhanced condensation efficiency of hot and humid air may be accomplished owing to provision of the plural condensers 130, 135, 136 and the above described position of the vent 104. Accordingly, it may be possible to prevent hot and humid air from being discharged through the vent 104 in an insufficiently condensed state, and this may reduce the amount of steam generated due to hot and humid air to one third as compared to a typically generated amount of steam. In addition, as the guide rib 134 guides dry outside air introduced through the vent 104 to move to the communication hole 101, there occurs no deterioration of drying efficiency.

According to one embodiment, the water supply pipe 108 may be connected to the wash water flow path 140. The wash water flow path 140 may include a first flow path 140*a*, one end of which communicates with the water supply pipe 108 for movement of wash water from the lower end to the upper end of the air brake 100, and a second flow path 140*b* for movement of wash water from the upper end to the lower end of the air brake 100. That is, the first flow path 140*a* and the second flow path 140*b* may have an inverted U-shaped form.

The sensor unit 105; 110; 111 may be located at a lower end of the second flow path 140*b* to sense the amount of water supplied. Wash water having passed the sensor unit 105; 110, 111 may move through a third flow path 140*c* to thereby be introduced into the tub 11 through the communication hole 101. The third flow path 140*c* may connect the sensor unit 105; 110; 111 and the communication hole 101 with each other. According to one embodiment of the present invention, the second flow path 140*b* and the third flow path 140*c* may have a U-shaped form.

The length of a flow path to ensure flow stability of wash water is short, and thus flow stability of wash water is low. Therefore, an error between the amount of wash water detected by the sensor unit 105; 110; 111 and an actually supply amount of wash water is about 7%.

However, according to one embodiment, due to the fact that the first flow path 140*a* and the second flow path 140*b* connected to the water supply pipe 108 have an inverted U-shaped form, the length of a flow path to achieve fluid stability of wash water is increased, which may contribute to fluid stability of wash water. Thereby, an error between the amount of wash water detected by the sensor unit 105; 110; 111 and an actually supplied amount of wash water may be reduced to 0-2%. Consequently, usage of wash water may be reduced and excessive supply of water may be prevented, resulting in reduced discharge of steam and increased energy efficacy.

Figure 9A:
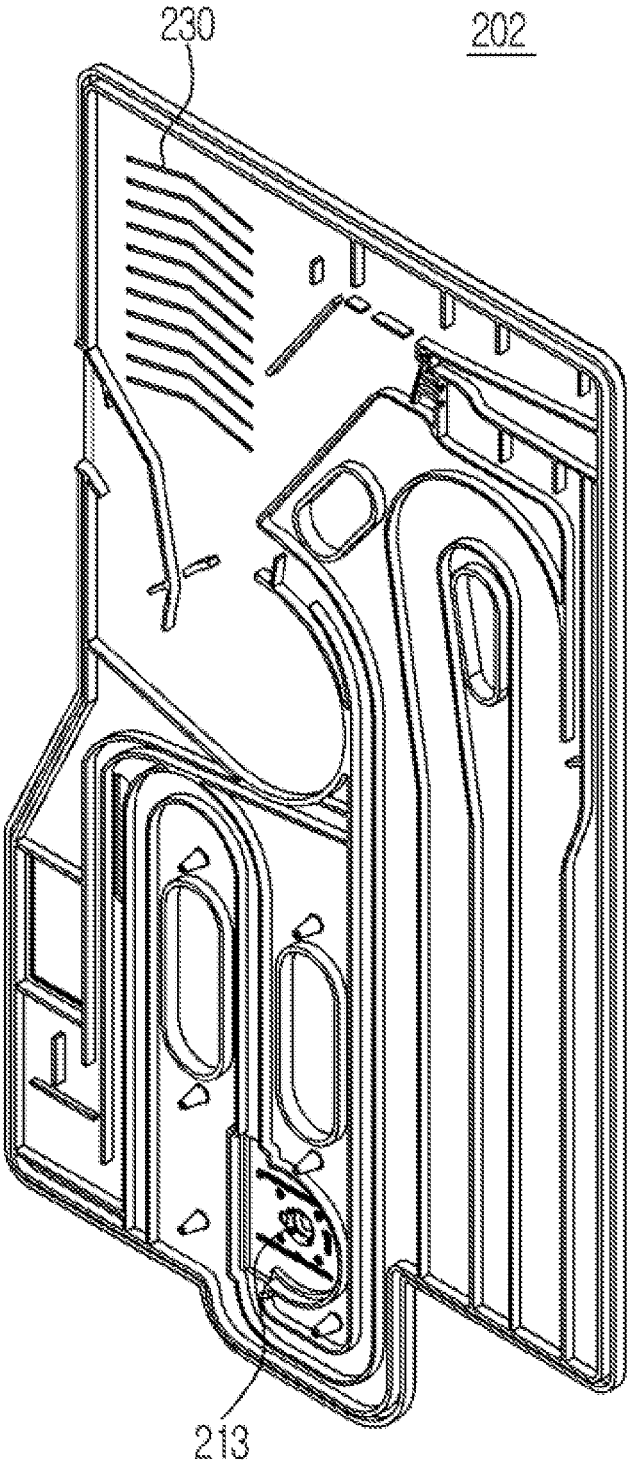
FIG. 9A is a view showing one surface of a second housing constituting an air brake of the dishwasher according to one embodiment.
Figure 9B:
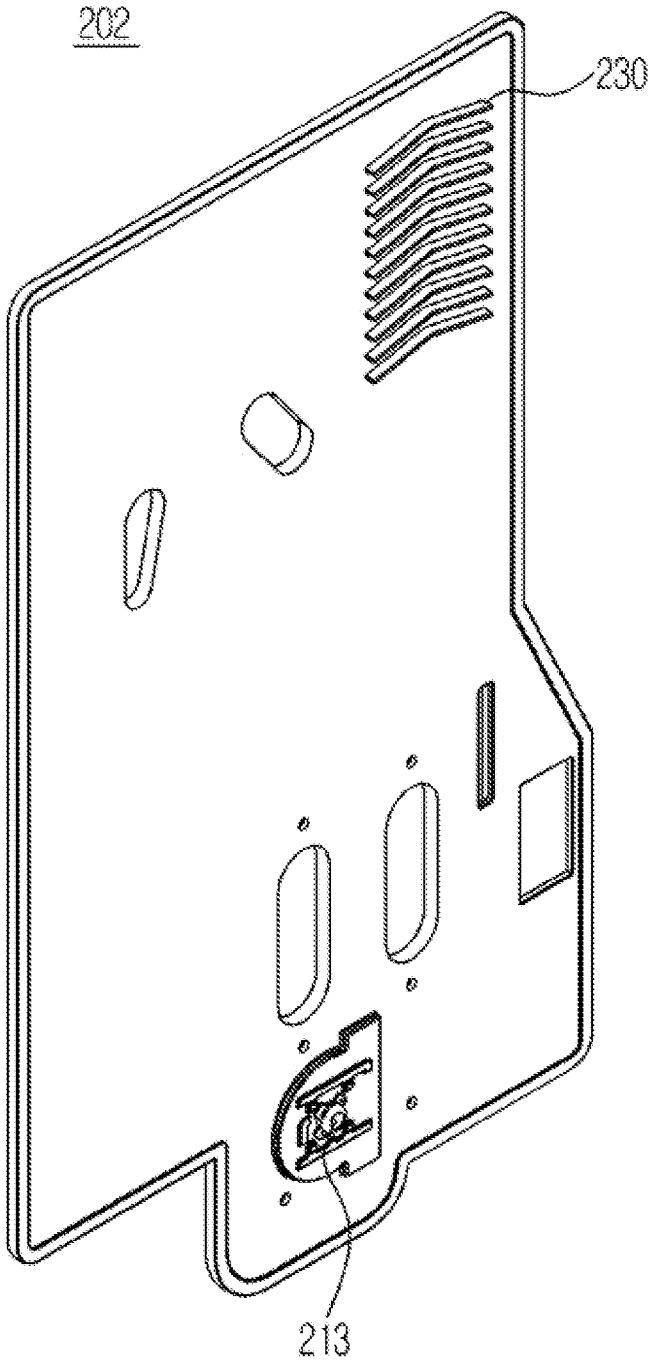
FIG. 9B is a view showing the other surface of the second housing constituting the air brake of the dishwasher according to one embodiment.

FIG. 9A is a view showing one surface of the second housing constituting the air brake of the dishwasher according to one embodiment, and FIG. 9B is a view showing another surface of the second housing constituting the air brake of the dishwasher according to one embodiment.

According to one embodiment as exemplarily shown in FIGS. 9A and 9B, a second condenser 230 may protrude from a surface of a second housing 202 outward of an air brake. Even in this case, contact area between air and the second condenser 230 may be increased, which results in efficient condensation of hot and humid air.

As is apparent from the above description, according to one aspect of the present invention, a vent of an air brake for introduction or discharge of air is located at a lateral surface of the air brake to ensure that air is discharged after being condensed, which may prevent damage to furniture due to hot and humid air.

Further, according to one aspect, through an improved wash water flow path, fluid stability of wash water may be accomplished, which may ensure accuracy in the supply of wash water and prevent an excessive amount of water from being supplied into a tub.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A dishwasher comprising:

a main body;

a tub placed within the main body to receive dishes therein; and an air brake mounted to one lateral surface of the tub, wherein the air brake includes:

a communication hole communicating with the tub to allow air or wash water to be introduced into the tub;

a vent formed at a side of the communication hole to allow air to be discharged outward from the air brake or to allow outside air to be introduced into the air brake;

a guide rib extending from the communication hole to the vent; and a plurality of condensers formed at a plurality of points on an air flow path and configured to condense humid air introduced into the air brake, wherein the air brake is constructed by coupling a first housing to a second housing, the first housing being coupled to the tub, at least one of the plurality of condensers is formed at the first housing, at least one of the plurality of condensers is formed at the second housing, the vent is located higher than the communication hole, and a first end of the guide rib is connected to an upper end of the vent and a second end of the guide rib is connected to the communication hole.

2. The dishwasher according to claim 1, wherein the first housing is provided with the guide rib defining a partition of the vent to guide air, introduced through the communication hole, toward the vent.

3. The dishwasher according to claim 2, wherein the plurality of condensers includes a first condenser formed at the first housing, a second condenser formed at the second housing, and a third condenser extending from the guide rib.

4. The dishwasher according to claim 3, wherein the first condenser and the second condenser are separated from the vent.

5. The dishwasher according to claim 3, wherein the second condenser protrudes from a surface of the second housing inward of the air brake.

6. The dishwasher according to claim 3, wherein the second condenser protrudes from a surface of the second housing outward of the air brake.

7. A dishwasher comprising:

a main body;

a tub placed within the main body to receive dishes therein; and an air brake mounted to one lateral surface of the tub, wherein the air brake includes:

a communication hole communicating with the tub to allow air to be introduced into the tub or to be discharged from the tub;

a guide rib configured to guide air, introduced through the communication hole, upward into the air brake;

a vent formed in a lateral surface of the air brake to allow air to be discharged outward from the air brake or to allow outside air to be introduced into the air brake, the vent being located below the guide rib to prevent hot air from being discharged from the air brake; and a plurality of condensers formed at a plurality of points on an air flow path, wherein the air brake is constructed by coupling a first housing to a second housing, the first housing being coupled to the tub, at least one of the plurality of condensers is formed at the first housing, at least one of the plurality of condensers is formed at the second housing, the guide rib extends from the communication hole to the vent, the vent is located higher than the communication hole, and a first end of the guide rib is connected to an upper end of the vent and a second end of the guide rib is connected to the communication hole.

8. The dishwasher according to claim 7, wherein the plurality of condensers includes a first condenser formed at the first housing and a second condenser formed at the second housing.

9. The dishwasher according to claim 7, wherein the communication hole and the guide rib are formed at the first housing.

10. The dishwasher according to claim 7, wherein at least a portion of the guide rib is bent.

11. The dishwasher according to claim 7, wherein the guide rib includes a partition extending from the vent.

12. The dishwasher according to claim 8, wherein the second condenser protrudes from a surface of the second housing inward of the air brake.

13. The dishwasher according to claim 8, wherein the second condenser protrudes from a surface of the second housing outward of the air brake.

14. The dishwasher according to claim 7, further comprising a wash water flow path including a first flow path for movement of wash water from a lower end to an upper end of the air brake and a second flow path for movement of wash water from the upper end to the lower end of the air brake.

15. The dishwasher according to claim 14, wherein the air brake further includes a sensor unit to sense the amount of wash water introduced into the air brake, and wherein the wash water is introduced into the tub through the communication hole after passing the sensor unit.

16. A dishwasher comprising:

a main body;

a tub placed within the main body to receive dishes therein; and an air brake mounted to one lateral surface of the tub, wherein the air brake includes:

a communication hole communicating with the tub to allow air to be introduced into the tub or to be discharged from the tub;

a vent defining a passage in a lateral surface of the air brake to allow air to be discharged outward from the air brake or to allow outside air to be introduced into the air brake;

a guide rib extending from the communication hole to the vent;

a wash water flow path to guide wash water into the tub, the wash water flow path including a first flow path for movement of wash water from a lower end to an upper end of the air brake and a second flow path for movement of wash water from the upper end to the lower end of the air brake; and a plurality of condensers formed at a plurality of points on an air flow path, wherein the air brake is constructed by coupling a first housing to a second housing, the first housing being coupled to the tub, at least one of the plurality of condensers is formed at the first housing, at least one of the plurality of condensers is formed at the second housing, the vent is located higher than the communication hole, and a first end of the guide rib is connected to an upper end of the vent and a second end of the guide rib is connected to the communication hole.

17. The dishwasher according to claim 16, wherein the air brake further includes a sensor unit to sense the amount of wash water introduced into the air brake.

18. The dishwasher according to claim 17, wherein the wash water flow path further includes a third flow path connecting the sensor unit and the communication hole to each other.

19. The dishwasher according to claim 16, wherein the air brake further includes the guide rib defining a partition between at least a portion of the communication hole and the vent, so as to guide air, introduced through the communication hole, upward into the air brake.

* * * * *